US005111785A

United States Patent [19]

Frase

[11] Patent Number: 5,111,785

[45] Date of Patent: May 12, 1992

[54] ENGINE PROTECTOR WITH NON-OVERRIDE RESET

[75] Inventor: Roland J. Frase, Roselle, Ill.

[73] Assignee: General Motors Corporation, Detroit, Mich.

[21] Appl. No.: 728,411

[22] Filed: Jul. 11, 1991

[51] Int. Cl.[5] ..... F01P 5/14

[52] U.S. Cl. ..... 123/198 D; 123/41.15

[58] Field of Search ..... 123/41.15, 196 S, 198 D, 123/198 DB

[56] References Cited

U.S. PATENT DOCUMENTS 3,246,641 4/1966 Goehring ..... 123/198 D
3,452,732 7/1969 Johansson ..... 123/198 DB
3,492,983 2/1970 Vipperman ..... 123/198 DB
3,620,204 11/1971 Baltadonis ..... 123/41.15
3,958,548 5/1976 Koci et al. ..... 123/198 D

*Primary Examiner*—Noah P. Kamen
*Attorney, Agent, or Firm*—Robert J. Outland

[57] ABSTRACT

Fluid pressures in an internal combustion engine are monitored by two diaphragm operated valves and open either valve when abnormal pressures are sensed to shut down the engine. Each valve is a sleeve valve slidable on a stem and normally latched to the stem. The stem carries a reset button and is spring biased to hold the valve in closed position. A valve is released from the stem when abnormal pressures are detected and the valve is spring biased to the open position. If the reset button is held in to override the protective function, the latch release and valve opening will still occur.

7 Claims, 2 Drawing Sheets

ENGINE PROTECTOR WITH NON-OVERRIDE RESET

TECHNICAL FIELD

This invention relates to protective devices for stopping or otherwise modifying engine operation in response to the occurrence of an undesired condition. In particular, the present invention relates to a protective device having a reset mechanism which can, when appropriate, restore engine operation after being stopped by the protective device but can not override the protection function.

BACKGROUND

U.S. Pat. No. 3,246,641 to Goehring granted Apr. 19, 1966 and assigned to the assignee of the present invention discloses a combination engine protective device operable to stop operation of an internal combustion engine upon the happening of certain abnormal conditions such as, for example, excessive crankcase or air box pressure or inadequate water pressure in the engine cooling system. The device is operative upon occurrence of any of these abnormal operating conditions to open a valve so as to drain oil from a pressure line connected with the engine governor. The pressure drop in the oil line in turn actuates means in the engine governor to stop operation of the engine.

The water-air box pressure portion of the protective device comprises a latching member engaged by a pair of diaphragms, one of which is responsive to pressure in the engine cooling system to urge the member toward its "latch" position and the other of which is responsive to pressure in the engine air box to urge the member toward its "release" position. In normal engine operation, the pressures in both the cooling system and the air box vary as functions of engine speed and so tend to offset one another. If, however, the engine water pressure is reduced or the air box pressure is increased an abnormal amount, the latching member is moved to its "release" position, tripping the protection device and stopping the engine.

The crankcase pressure portion of the protective device comprises a second latching member engaged by a single diaphragm responsive to pressure in the crankcase and to atmospheric pressure. The crankcase pressure is effective when it reaches an abnormal amount to urge the latching member to its release position, tripping the protective device and stopping the engine.

U.S. Pat. No. 3,958,548 to Koci et al granted May 25, 1976 and assigned to the assignee of the present invention discloses an improved engine protective device which refined the earlier invention and which, in lieu of the water pressure, uses the water pump inlet and outlet pressures applied to opposite sides of a diaphragm to arrive at a difference of those pressures which then is offset by the air box pressure to determine whether an abnormal pressure condition is present, and releases the latching member accordingly.

In each of those patents, the latching members hold the respective release valves in closed position but when released a spring bias opens the valves. Each of the latching members, when released, can be reset when the pressure condition returns to normal by pushing in a manually operated reset button attached to the valve to return the valve to closed position where the latch engages. While the devices of both the above-cited patents have been satisfactorily operated for many years, it has been found that a side effect of that construction is that, in an attempt to override the engine protector, the reset button might be held in to prevent valve opening when the "release" condition occurs.

SUMMARY OF THE INVENTION

The present invention constitutes an improvement to the protective device arrangement disclosed in the above cited patents. The improved arrangement defeats any override attempts by a modified structure of the valve and reset mechanisms.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
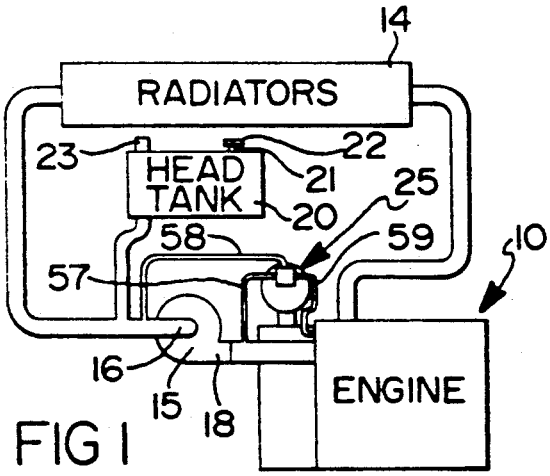
FIG. 1 is a schematic representation of an internal combustion engine having a pressurized cooling system and engine protective means formed in accordance with the prior art.

Referring now to the drawings in detail, numeral 10 generally indicates an internal combustion engine which mounts a governor 11 that includes a mechanism for controlling and stopping the engine, the latter being operated by a reduction of oil pressure in an oil pressure line 12 connected with the governor 11 and with other portions of the engine oil supply system, not shown.

The engine also includes a cooling system having internal passages, not shown, which are connected externally in a closed loop through cooling radiators 14 and a water pump 15. The pump 15 is mounted on the engine and is driven thereby at a speed varying proportionally to engine speed. Pump 15 has an inlet 16, connected to receive water or other liquid coolant from the radiators, and an outlet 18, connected to deliver the coolant under pressure to the engine.

The cooling system further includes a head tank 20 connected with the cooling system on the inlet side of the pump so as to provide a head of cooling water that normally maintains a positive pressure on the pump inlet. The head tank is provided with a filler opening 21 closed by a pressure cap 22 to permit the cooling system to be pressurized. A pressure relief valve 23 is also provided in the system to relieve pressures in excess of a predetermined minimum.

Engine 10 is also provided with an accessory housing 24 on which is mounted an engine protective device 25 which includes a crankcase pressure responsive portion 27 and a coolant pressure responsive portion 28, either of which opens its respective valve in response to a certain pressure condition to drain oil to a drain line 32 from a valve body 31 connected with the engine oil line 12. This results in a pressure reduction in the oil line 12 which is sensed by the governor, actuating its shutdown mechanism and stopping the engine.

The coolant pressure responsive portion 28 includes a spring biased sleeve valve 34 reciprocably slidably carried on a valve stem 35 for closure against a seat 30. The stem 35 is reciprocably carried in the valve body 31 and has a latching groove 36 near its inboard end. The sleeve valve 34 has apertures which retain a plurality of latching balls 41 that are engageable with the groove 36 to releasably latch the valve 34 to the stem 35. A reset button 29 is fixed on the outboard end of the stem 35 and a spring 33 between the button 29 and the valve body biases the stem outward and moves the sleeve valve to closed condition when the valve 34 is latched to the stem 35. A spring 37 between the valve body 31 and the sleeve valve 34 urges the valve to open position when the valve is released from the stem. The spring force of spring 37 is somewhat less than that of the spring 33 so that when the valve 34 is latched to the stem 35 and the two springs act in opposition, the spring 33 is dominant to assure closing the valve. The valve, when closed, separates the oil line 12 from the drain line 32.

Figure 2:
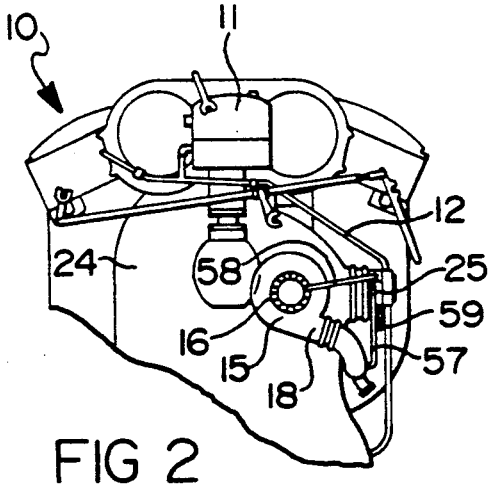
FIG. 2 is an end view of an engine showing the application of an engine protective device in accordance with the prior art.

A multi-piece housing 40 receives the inboard ends of the sleeve valve 34 and stem 35 as well as a reciprocably movable assembly 42 which carries a latching sleeve 44 for telescoping engagement with the sleeve valve 34 to hold the balls 41 in the groove 36 when in an advanced position and to release the balls when in a retracted position, allowing the valve 34 to slide on the stem to assume its open condition. The movable assembly 42 includes four spaced diaphragms 45, 46, 47, and 48 which are secured within the housing 40 and divide the interior thereof into five chambers, 51–55. Chambers 52 and 54 are connected with atmosphere. Chamber 51 is connected through an external tube 57 (FIG. 2) with the engine cooling system adjacent the coolant pump outlet. Chamber 53 is connected through an external tube 58 (FIG. 2) with the engine cooling system adjacent the coolant pump inlet. Chamber 55 is connected through a tube 59 with the engine air box, not shown, formed internally of the engine.

Figure 4:
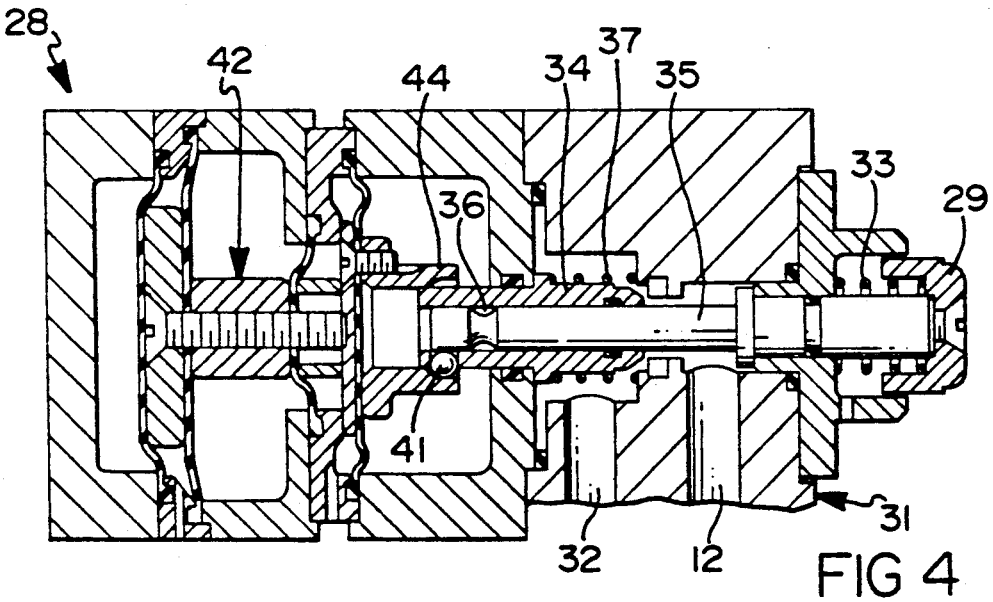
FIGS. 4 and 5 are cross-sectional views of each of the valves in the device of FIG. 3 illustrating the open valve positions.
Figure 3:
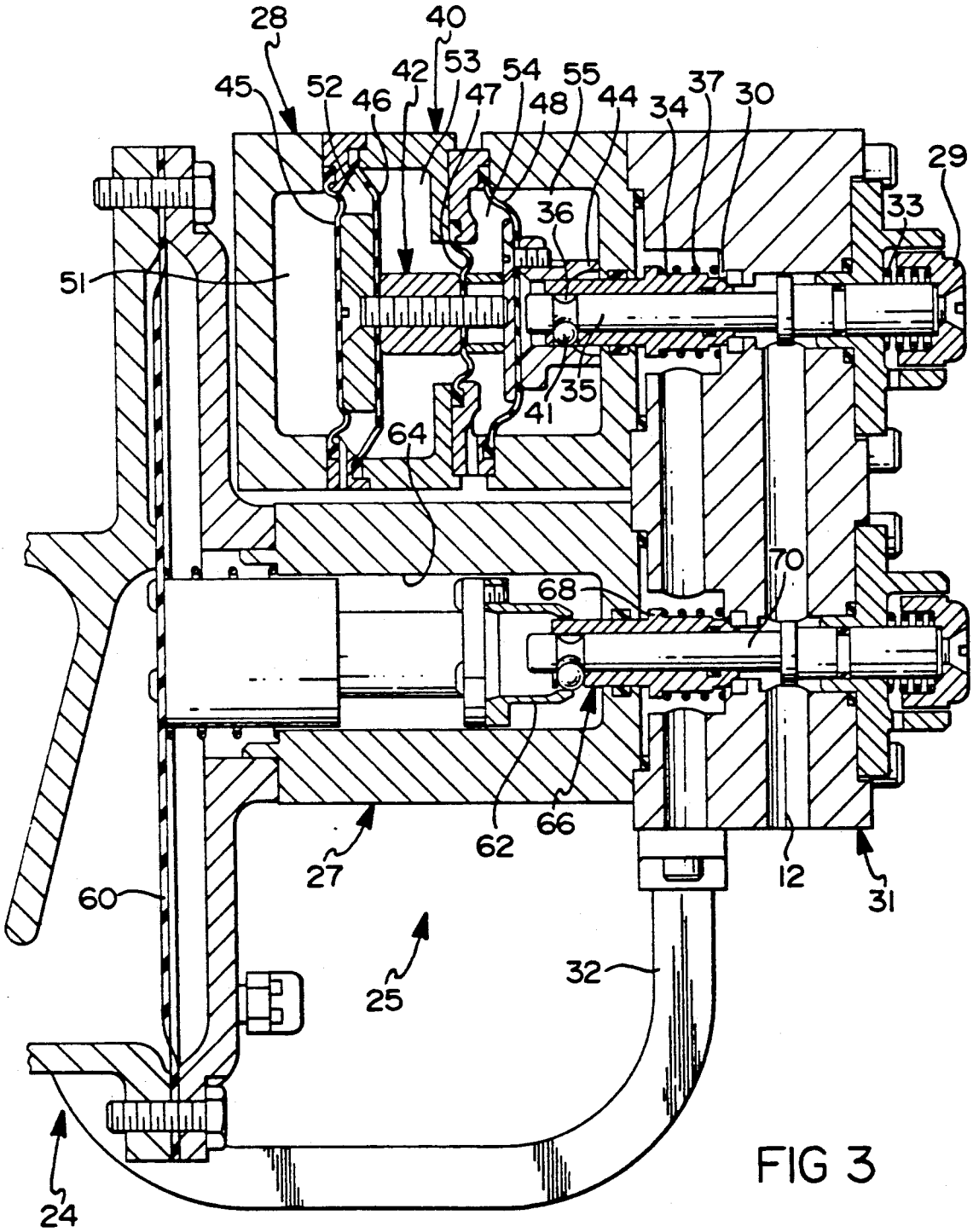
FIG. 3 is a cross-sectional view of the improved engine protective device according to the invention and applied to the engine of FIG. 2.

In operation, the engine drives the water pump 15 at a speed proportional to engine speed. The pump causes circulation of the coolant in a closed loop and as the pump speed increases the differential pressure between the inlet and outlet increases. The differential pump pressure is also a measure of the amount of coolant flow. The charging pressure in the engine air box also increases with engine speed. The pressures acting on the respective diaphragms result in a force which in normal operation biases the member 42 rightward, as shown in FIG. 3, causing the latching sleeve to maintain the latching balls 41 in the groove 36, and the sleeve valve is held in its closed position. When abnormal pressures occur, either in the coolant system or in the air box, the member 42 will be moved leftward, releasing the latching balls and permitting the valve 34 to open, as shown in FIG. 4. This action will drain the oil from line 12 to drain line 32 and actuate the governor shutdown mechanism, stopping the engine. Further details regarding the balancing of pressures and the effect of each pressure variation are provided in the above-mentioned U.S. Pat. No. 3,958,548, which is incorporated herein by reference.

When normal pressure relationships are restored the protective device is reset by manually pushing in the reset button 29 to move the stem inward to align the groove 36 with the latching balls 41. The member 42 is moved outward by the pressures on the diaphragms to cam the balls into the groove 36 to latch the valve 34 to the stem 35. As the reset button is released, the stem 35 and valve 34 as well as the member 42 move outward until the valve is closed. If reset is attempted prior to the recovery of normal pressure relationships, the member 42 will not be urged toward the right sufficiently to hold the latching balls 41 in the groove 36.

When the latch mechanism is released, the stem 35 normally moves outward. If the stem is prevented from so moving, the sleeve valve 34 will still move to its open position. Thus holding in the reset button in an attempt to override the protective function will have no effect on the valve opening and the protective function cannot be defeated.

Figure 5:
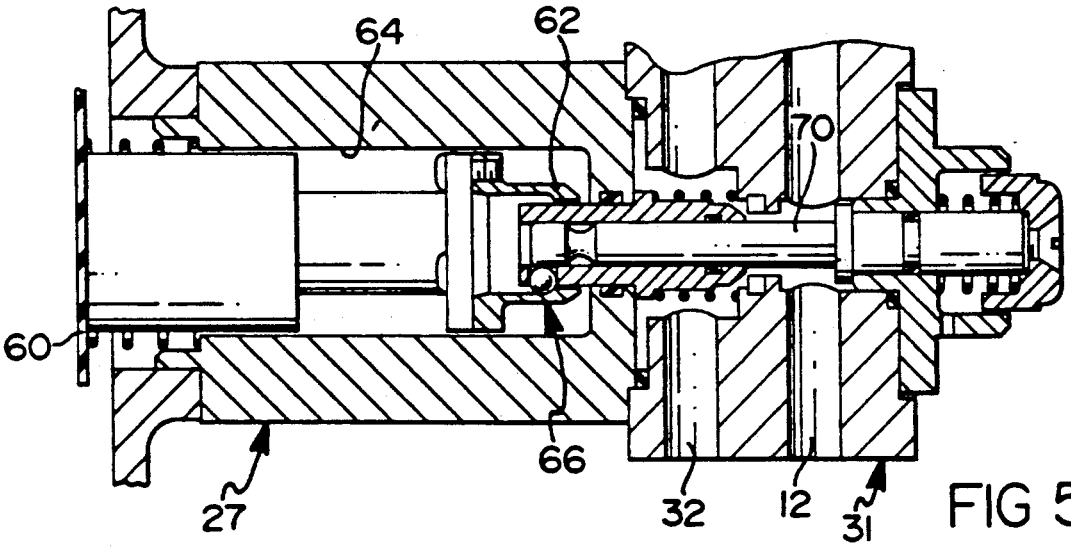

The crankcase pressure responsive portion 27 of the protective device 25 comprises a large diaphragm 60 subject to crankcase pressure on one side and atmospheric pressure on the other side. A latching sleeve 62 slidably mounted in a bore 64 and positioned by the diaphragm 60 telescopically engages a latching mechanism 66 which latches a sleeve valve 68 to a stem 70. The valve 68 and stem 70 assembly and the latching mechanism 66 are the same as the corresponding members in the coolant pressure responsive portion 28 and operate in the same manner, except for an opposite direction of movement of the diaphragm member upon the occurrence of abnormal pressure conditions. For normal crankcase pressures the diaphragm assumes a leftward position to maintain the latch mechanism in latched condition. Abnormal crankcase pressure moves the diaphragm and the latching sleeve 62 to the right to release the valve 68 from the stem to cause the valve to open, as shown in FIG. 5, thereby reducing the oil pressure in line 12 resulting in shutting down the engine. As described in the previous example, the protective function cannot be overridden by holding in the reset button.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine protector for monitoring at least one engine fluid pressure and signaling engine turn-off when such pressure reaches a prescribed limit condition comprising:

a housing;

a valve actuator movably mounted in the housing;

first biasing means acting on the valve actuator for biasing the valve actuator in one direction;

a valve mounted in the housing for movement in opposite directions for valve opening and closing movement;

means for releasably coupling the valve actuator to the valve;

second biasing means acting on the valve for biasing the valve in one direction to a turn-off signaling position, the first biasing means being capable of overcoming the second biasing means when the valve is coupled to the valve actuator for biasing the valve in the other direction to a normal position; and means responsive to engine fluid pressure reaching a prescribed limit condition for releasing the coupling means to permit valve operation to signal engine turn-off.

2. An engine protector for monitoring at least one engine fluid pressure and effecting engine control when such pressure reaches a prescribed limit condition comprising:

a housing;

a valve stem mounted in the housing for axial movement;

a first spring acting on the valve stem for biasing the valve stem in the outboard direction;

a sleeve valve slidably mounted on the stem for axial valve operating movement;

a second spring acting on the sleeve valve for biasing the sleeve valve in the inboard direction, the first spring being sufficiently strong to overcome the second spring when the valve stem is coupled to the valve sleeve;

latch means for releasably coupling the valve stem and the sleeve valve to hold the valve sleeve in normal outboard position under influence of the first spring; and means responsive to engine fluid pressure reaching a prescribed limit condition for releasing the latch means to permit sleeve valve movement in the inboard direction to effect engine control.

3. The invention as defined in claim 2 wherein the engine fluid pressure comprises crankcase pressure;

the prescribed limit condition is a maximum allowed pressure; and the means responsive to engine fluid pressure is diaphragm means subject to crankcase pressure and to a set bias representing the maximum allowed pressure.

4. The invention as defined in claim 2 wherein the engine has an air box and a water pressure system, and wherein:

the engine fluid pressure includes water inlet and outlet pressures and air box pressure; and the means responsive to engine fluid pressure is diaphragm means responsive to water inlet and outlet pressures and air box pressure, and the prescribed limit condition is a particular relationship of the air box pressure and the difference of the water inlet and outlet pressures.

5. A protective device for an internal combustion engine having a crankcase, an air box, a water pressure system, an oil pressure system and engine stopping means including a connection with the oil pressure system and operable to stop the engine upon a reduction in oil pressure in the connection to a predetermined amount, said protective device comprising:

a housing;

inlet means in the housing adapted to be connected with the oil pressure connection to the engine stopping means;

outlet means in the housing;

first and second valve means having open and closed positions and each coupled to the inlet means and the outlet means to control communication of the inlet means with the outlet means;

the first valve means having first pressure responsive means adapted to be connected with the engine crankcase and with atmosphere and to be movable in response to a predetermined relationship between the pressure in the crankcase and atmospheric pressure, the second valve means having second pressure responsive means adapted to be connected with the air box and the water pressure system and to be movable in response to a predetermined relationship between the air box and water system pressures;

each of the valve means including a valve, a valve actuator for holding the valve in a first position, releasable latch means operable by the respective pressure responsive means for coupling the valve to the valve actuator when latched, and means for moving the valve to a second position when the latch means is released; whereby each valve means is movable in response to fluid pressure to connect the inlet means with the outlet means to reduce the oil pressure in the connection and stop the engine.

6. The invention as defined in claim 5 wherein:

the valve actuator is an axially moveable stem biased to hold the valve in closed position when latched to the valve;

the valve is a sleeve valve slidably mounted on the stem for axial movement independently of the stem position when the latch means is released; and the means for moving the valve is a spring means for biasing the valve to open position when the latch is released, whereby the oil pressure is reduced when the valve is opened to stop the engine.

7. The invention as defined in claim 5 wherein a manually operated reset means is connected to the valve actuator effective when the latch means is released for resetting the latch means to restore the oil pressure for engine operation.

* * * * *